US005564318A

United States Patent [19]

Pail

[11] Patent Number: 5,564,318

[45] Date of Patent: Oct. 15, 1996

[54] FOLDING TOOL

[76] Inventor: Opher Pail, 595 Main St., Apt. 1115, New York, N.Y. 10044

[21] Appl. No.: 414,403

[22] Filed: Mar. 31, 1995

[51] Int. Cl.[6] ..... B25B 7/00

[52] U.S. Cl. ..... 81/427.5; 7/128

[58] Field of Search ..... 81/427.5; 7/118, 7/125–131, 135, 167–168; 30/255

[56] References Cited

U.S. PATENT DOCUMENTS

| | | |
|---|---|---|
| 154,750 | 9/1874 | Flack . |
| 2,126,699 | 8/1938 | Florian . |
| 4,238,862 | 12/1980 | Leatherman . |
| 4,744,272 | 5/1988 | Leatherman . |
| 4,794,692 | 1/1989 | Wang . |
| 4,888,869 | 12/1989 | Leatherman . |
| 5,029,355 | 7/1991 | Thai . |
| 5,062,173 | 11/1991 | Collins et al. . |
| 5,142,721 | 9/1992 | Sessions et al. . |
| 5,212,844 | 5/1993 | Sessions et al. . |
| 5,267,366 | 12/1993 | Frazer . |

FOREIGN PATENT DOCUMENTS

| | | |
|---|---|---|
| 87089 | 6/1896 | Germany . |
| 5044 | 3/1895 | United Kingdom . |

*Primary Examiner*—D. S. Meislin
*Attorney, Agent, or Firm*—Felfe & Lynch

[57] ABSTRACT

The folding tool of this invention has first and second jaw structures which are pivotable with respect to each other into an out of operative engagement with each other. A first handle portion and a support plate and second handle pivot with respect to the jaw structures about substantially the same axis. The first handle portion and the support plate can be rotated with respect to the jaw structures so that the jaw structures are supported therebetween (the closed position), and also to a position where the jaw structures extend away from both the first handle portion and the support plate (the open position). In the open position, two springs on the support plate each engage a respective jaw structure. One of these springs springingly locks one of the jaw structures in the open position with respect to the support portion. The other spring engages a camming surface on the other jaw structure which biases the jaw structures apart, i.e., away from engagement with each other. The springs also serve to springingly secure the jaw structures between the support portion and the first handle in the closed position, so that the tool, when folded, is relatively compact and does not open inadvertently.

22 Claims, 6 Drawing Sheets

FOLDING TOOL

FIELD OF THE INVENTION

This invention relates to tools, and more particularly to folding tools, such as folding pliers.

DESCRIPTION OF THE PRIOR ART

In the prior art, it is known to provide various mechanisms for retracting or folding pliers. For instance, U.S. Pat. No. 4,238,862 to Leatherman discloses pliers wherein the handles are foldable. Other designs of collapsible pliers allow for retraction of the plier jaws into the space between the handles, as in U.S. Pat. No. 5,142,721 to Sessions et al. However, the complexity of the structure of each of these prior-art devices can cause problems as the number of moving parts makes a malfunction more likely, and also renders manufacture more expensive. Furthermore, the nature of the folding articulation of the plier handles renders unfolding of the tool in efficient.

SUMMARY OF THE INVENTION

Accordingly, it is an object of this invention to provide a folding tool which can be readily folded and unfolded, and is easy to manufacture.

The folding tool of this invention has first and second jaw structures which are pivotable with respect to each other into an out of operative engagement with each other. A first handle portion, and support plate and second handle are rotatably connected with the jaw structures and pivot with respect to the jaw structures about substantially the same axis. The first handle portion and the support plate can be rotated with respect to the jaw structures so that the jaw structures are supported therebetween (the closed position), and also to a position where the jaw structures extend away from both the first handle portion and the support plate (the open position). In the open position, two springs on the support plate each engage a respective jaw structure. One of these springs springingly locks one of the jaw structures in the open position. The other spring engages a surface on the other jaw structure which biases the jaw structures apart, i.e., away from engagement with each other. The springs also serve to springingly secure the jaw structures between the support portion and the first handle in the closed position, so that the tool, when folded, is relatively compact and does not open inadvertently.

Other objects and advantages of the invention shall become apparent in the specification herein, and the scope of the invention will be articulated in the claims.

DETAILED DESCRIPTION OF THE DISCLOSURE

Figure 3:
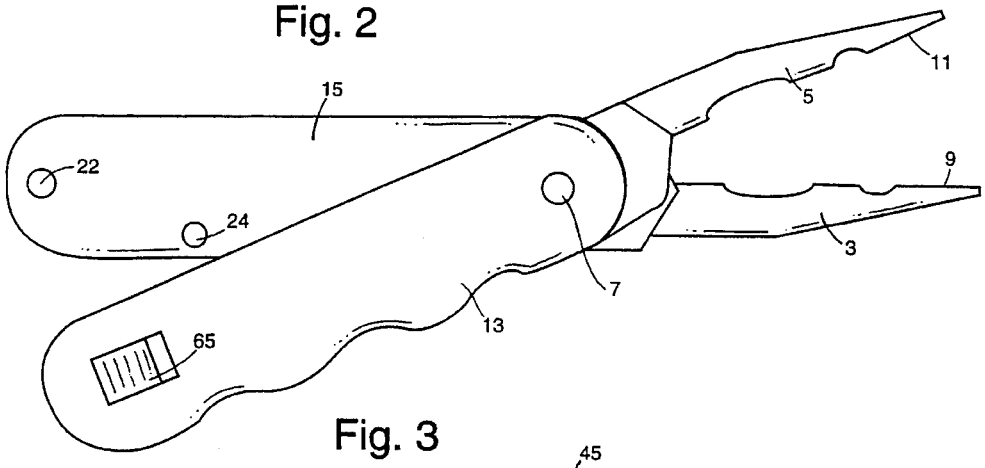
FIG. 3 shows the tool of the present invention in the open, or operational position.

As best shown in FIG. 3, the folding tool of the present invention has a first jaw 3 and a second jaw 5 which are pivotably connected with each other about pin 7. The jaws 3 and 5 have engagement structures 9 and 11 which are engageable with each other as in common pliers. The tool also comprises a first handle 13 and a support or body portion 15.

Figure 1:
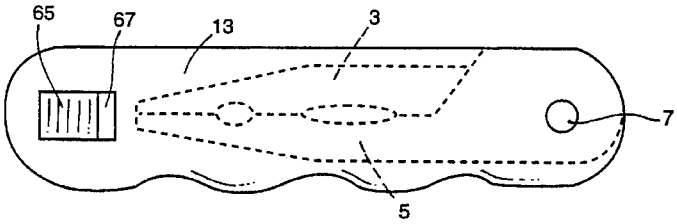
FIG. 1 shows an elevational view of the tool of the present invention in the closed position.
Figure 2:
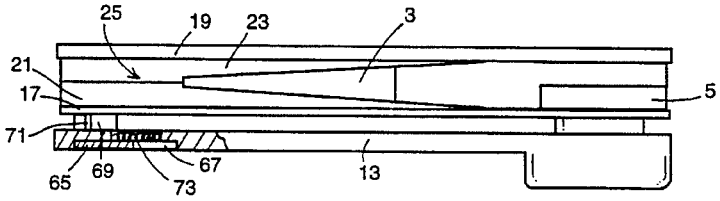
FIG. 2 is a plan view of the tool of FIG. 1.
Figure 5:
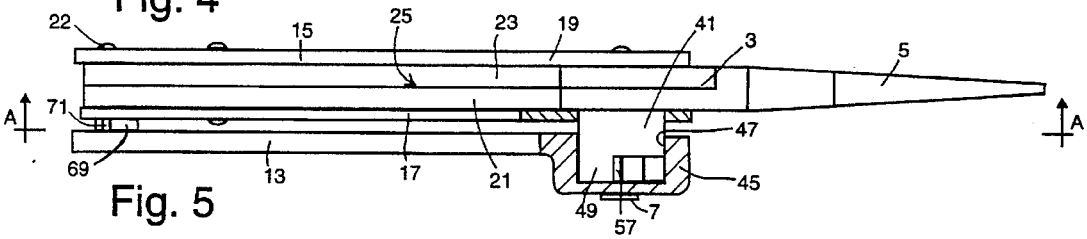
FIG. 5 is a partially cut-away plan view of the tool of FIG. 4.

As best shown in FIG. 5, the support portion 15 includes a support wall or plate 17 and a handle portion 19. Support wall 17 and handle portion 19 are spaced laterally with respect to each other and support therebetween the first and second biasing structures in the form of springs 21 and 23 cantileveredly supported by pins 22 and 24 extending through openings in support wall 17, the springs 21 and 23 themselves, and handle portion 19. The support wall 17 and the handle portion 19 define therebetween a space generally indicated at 25 into which the jaws 3 and 5 fit when the tool is folded into the closed position, as best seen in FIGS. 1 and 2.

Figure 4:
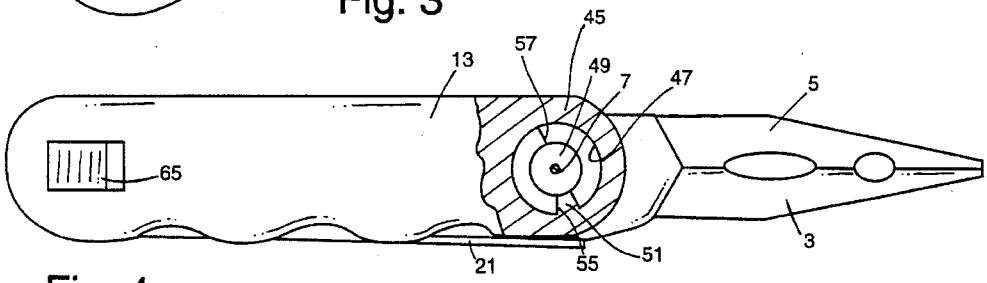
FIG. 4 shows the tool of FIG. 3 with the jaws in operative engagement.

When the tool is in the open position of FIG. 3, a user can grasp the tool and use it like common pliers, squeezing the handle 13 and the support structure 15 together to cause the jaw structures 3 and 5 to move into engagement as is shown in FIG. 4.

Figure 8:
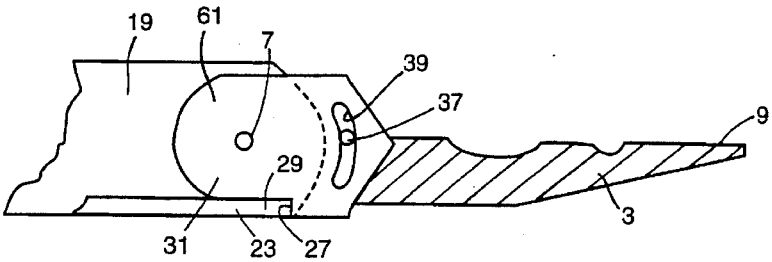
FIG. 8 shows one jaw structure springingly locked in the open position.
Figure 9:
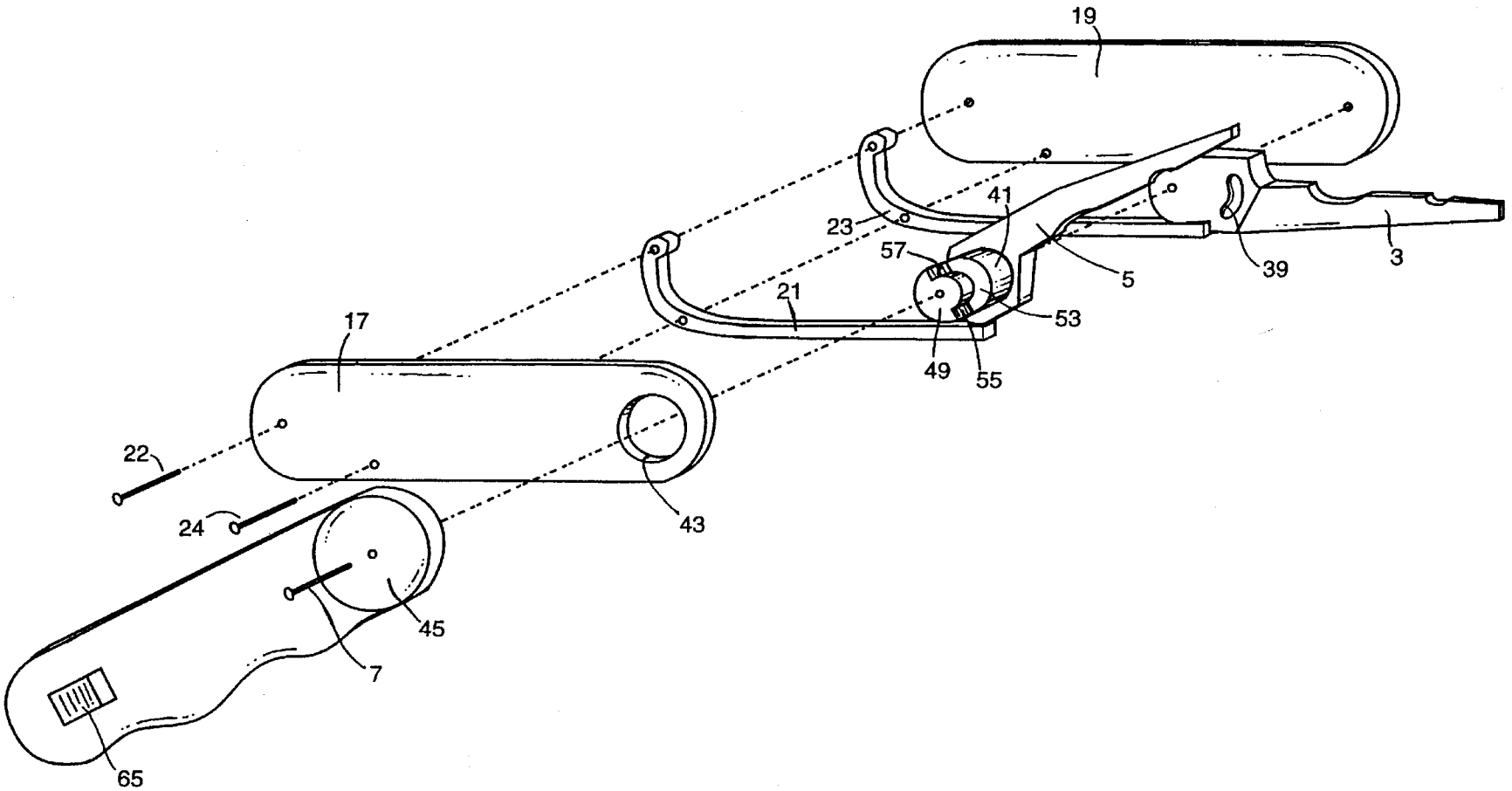
FIG. 9 is an exploded perspective view of the tool in the open position.

In the open position, first jaw 3 remains substantially fixed with respect to the support portion 15, and the second jaw 5 is carried to pivot with the handle portion 13. As best shown in FIGS. 8 and 9, in the open position, jaw 3 has a stop portion 27 which engages the end 29 of the spring 23, which acts as a rotational abutment or stop with respect to lengthwise loads. As a consequence, the jaw 3 cannot rotate clockwise about pin 7 beyond the point shown in FIG. 8. Furthermore, jaw 3 has a spring engagement portion 31 which engages spring 23 so that movement of the jaw 3 counter-clockwise with respect to handle portion 19 is resisted by the biasing force upward of spring 23 engaging said portion 31.

Figure 6:
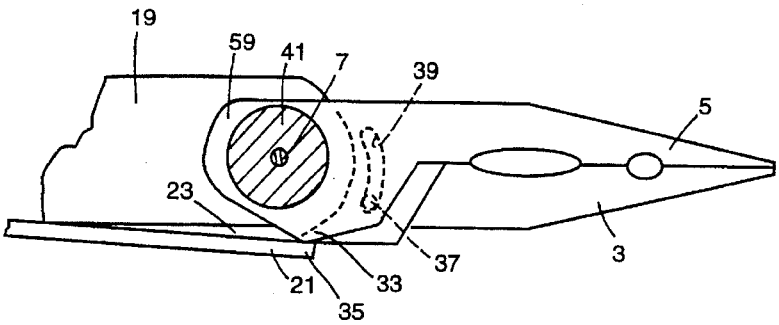
FIG. 6 is a partial view of the tool taken along line AA of FIG. 5, showing the jaw structure in engagement.
Figure 7:
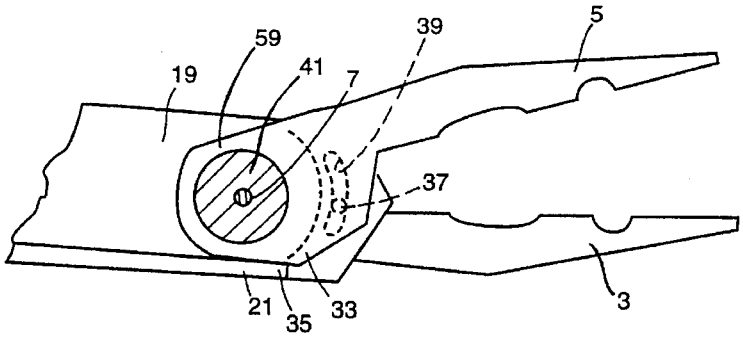
FIG. 7 is a view as in FIG. 6, but showing the jaws apart.

Jaw 5 also engages its respective spring 21 in the open position shown in FIG. 7. Jaw 5 has a camming engagement portion 33 which engages the end 35 of spring 21. When the pliers are squeezed by the user to cause the jaws 3 and 5 to come together, the camming engagement portion 33 presses downwardly on the end portion 35 of spring 21 causing the spring 21 to flex. When the jaws come completely together as in FIG. 6, the spring 21 is flexed downward to impart a force to jaw 5 which biases or urges the jaws 3 and 5 to separate back to the position of FIG. 7.

The jaws 3 and 5 are prevented from moving farther apart from each other than the position shown in FIG. 7. This is accomplished by a slot and pin connection between the structure of the two jaws. A pin 37 on jaw 5 slides in a slot 39 in jaw 3, limiting relative movement.

The connection of jaw 5 with the first handle portion 13 is a pivoting lost-motion connection. The jaw 5 includes a shaft portion 41 which extends through opening 43 in support wall 17. Handle 13 includes a connection portion 45 with a recess 47 therein that faces and receives the end 49 of shaft portion 41. The connection portion 45 has an abutment structure or stop 51 extending into the recess 47. This abutment structure 51 moves within semi-annular notch 53 in the end 49 of the shaft 41. Handle 13 is consequently permitted to rotate about pin 7 with respect to jaw 5 in a range of movement of about 180 degrees, which corresponds to movement between the position wherein the abutment 51 engages notch wall 55 and the position where it engages notch wall 57.

Figure 10:
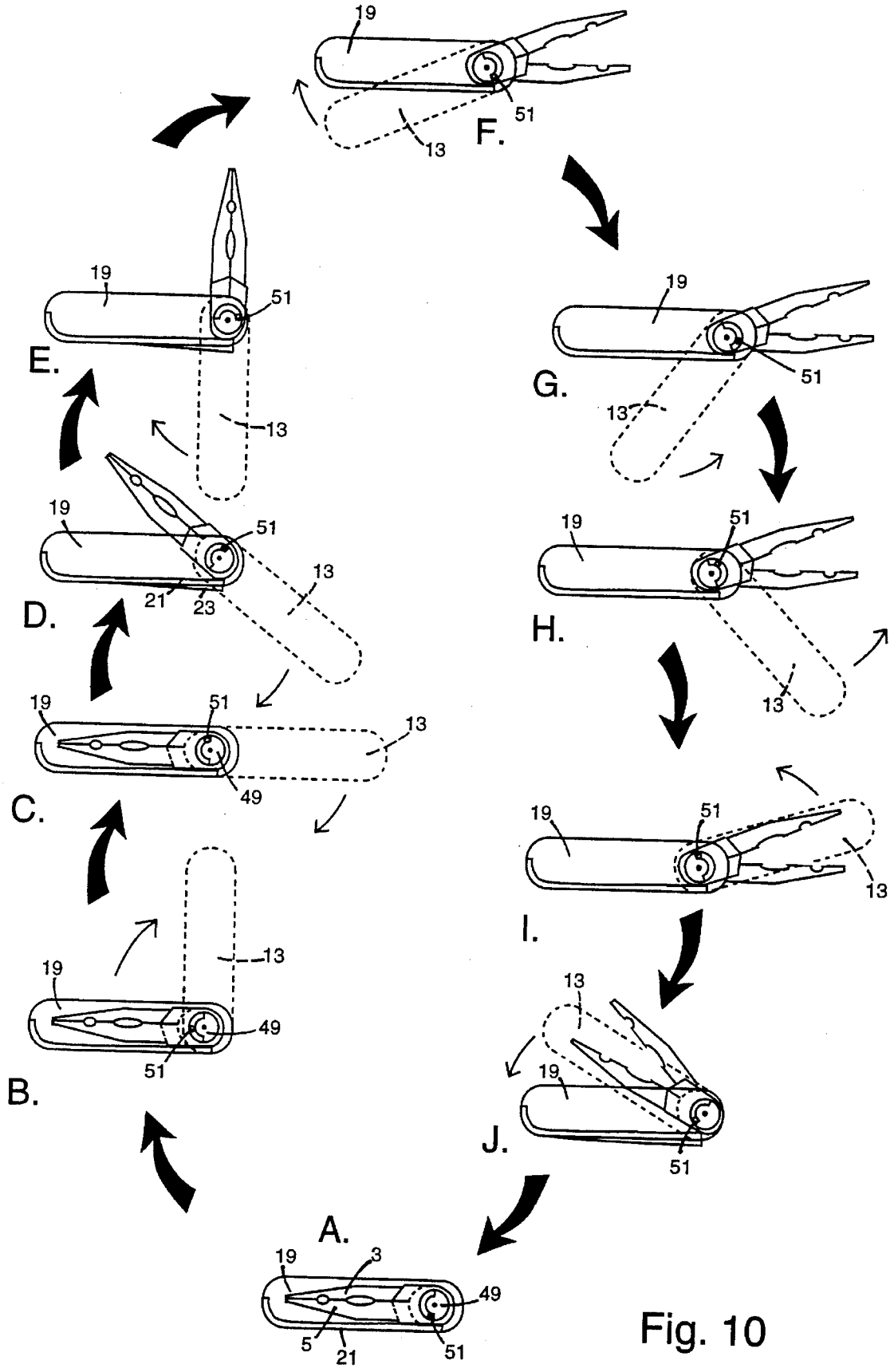
FIG. 10 is a schematic showing the various positions of the tool in the movement between the open and closed positions.

This lost-motion connection provides for opening and closing of the tool as is shown in FIG. 10. The closed position of the tool shown in FIG. 1 is indicated at position A in FIG. 10, with the support wall 17 cutaway and the position of handle portion 13 shown in phantom. To open the tool, handle portion 13 is initially rotated clockwise from the closed position, reaching the position shown in position B.

Clockwise rotation of handle portion 13 continues to the position C wherein abutment portion 51 contacts notch wall 55. As the handle 13 continues to be rotated clockwise, the abutment causes the jaw 5 to rotate with the handle 13 carrying with it jaw 3. This initial movement is resisted slightly by the springs 21 and 23 which engage spring engagement portions 59 and 61 of jaws 5 and 3 respectively. These engagement portions 59 and 61 are eccentric with respect to pin 7, so rotation of the jaws 3 and 5 out of the closed position is resisted by camming pressure of the springs 21 and 23 on the jaws. The jaws 3 and 5 are carried to rotate through positions D and E to reach the open operating position F, which is shown enlarged in FIG. 3.

To close the device, the operator rotates the handle portion 13 counterclockwise from the open operating position F to begin the closing process, initially reaching the position G. This initial closing movement of the handle 13 causes abutment portion 51 to slide in the notch 53 in shaft 41 without movement of jaw 5. Counterclockwise rotation of handle 13 continues through position H until position I, at which point abutment portion 51 engages wall 57 of notch 53. At this point, handle 13 begins to carry with it jaw 5. Jaw 5, in turn, by virtue of the slot and pin connection with jaw 3, begins to rotate jaw 3 counter clockwise with it. Continued rotation of handle 13 brings the tool to position J, where the camming pressure of springs 21 and 23 engages the jaws 3 and 5, closing them together and bringing the tool to position A once again.

The tool includes a latching structure generally indicated at 63. This includes a push button 65 which slides in a recess 67 in handle portion 13. The push button 65 has a catch portion 69 which is latchingly secured behind pin 71, and in this position prevents the handle portion 13 from being rotated to open the tool. The catch 69 and the button 65 are biased into latching securement by spring 73.

Figure 11:
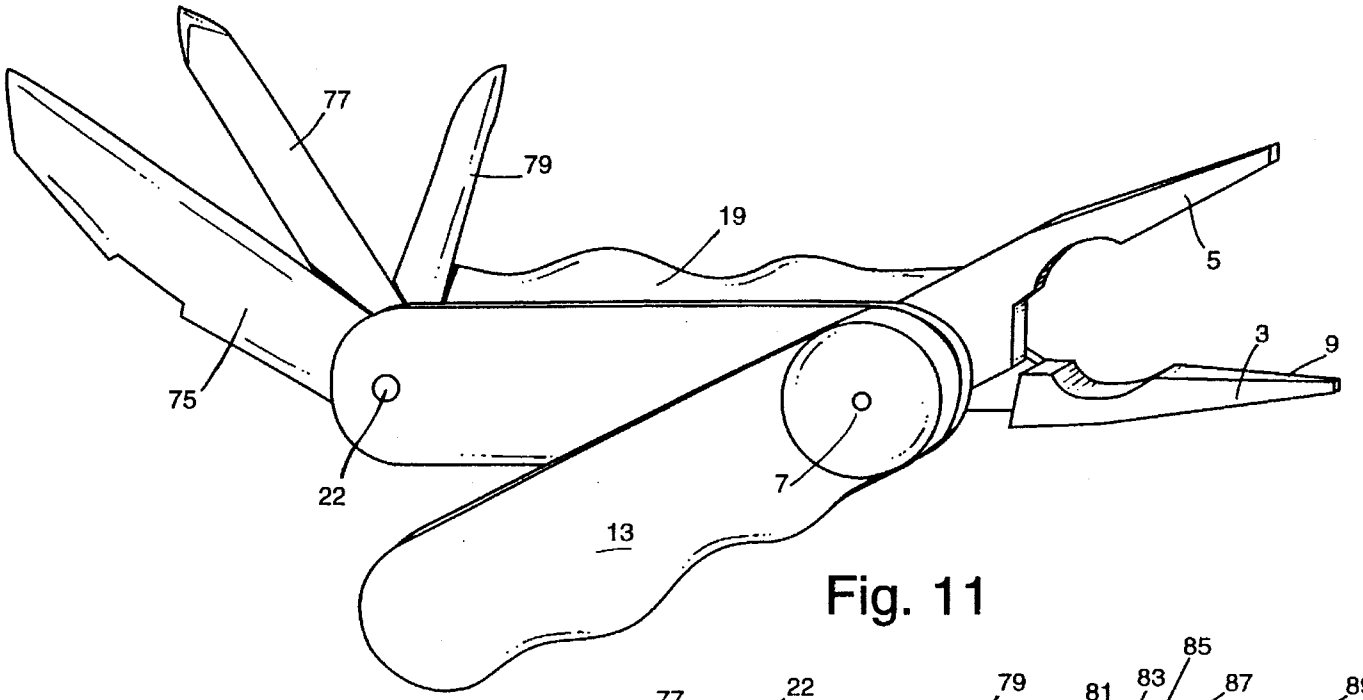
FIG. 11 is a perspective view of an alternate embodiment of the folding tool of the invention.
Figure 12:
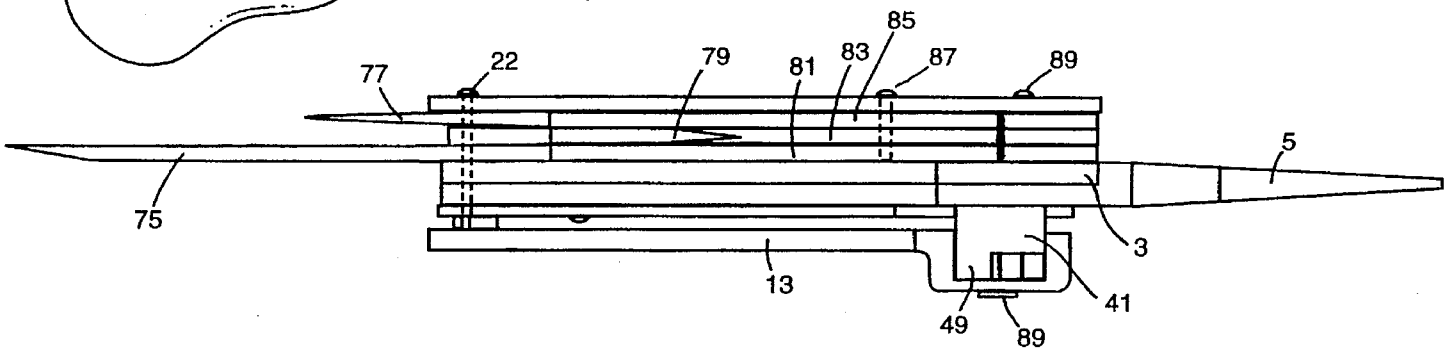
FIG. 12 is a plan view of the tool of FIG. 11.

An alternate embodiment is shown in FIGS. 11 and 12. In this embodiment, a plurality of supplemental tool structures 75, 77 and 79 are inserted between the handle portion 19 and the spring 23 and jaws 3 and 5. These tools are pivotally supported on pin 22. Each of the tools is associated with a respective spring 81, 83 and 85 which secures them open and springingly clasps them in a closed position between the handle portion 19 and the support wall in the space between handle portion 19 and support wall 17. The springs are cantilevered on pins 87 and 89, and the operation of these retractable tools 75, 77 and 79 is as is commonly known in the art of pocketknives.

Figure 13:
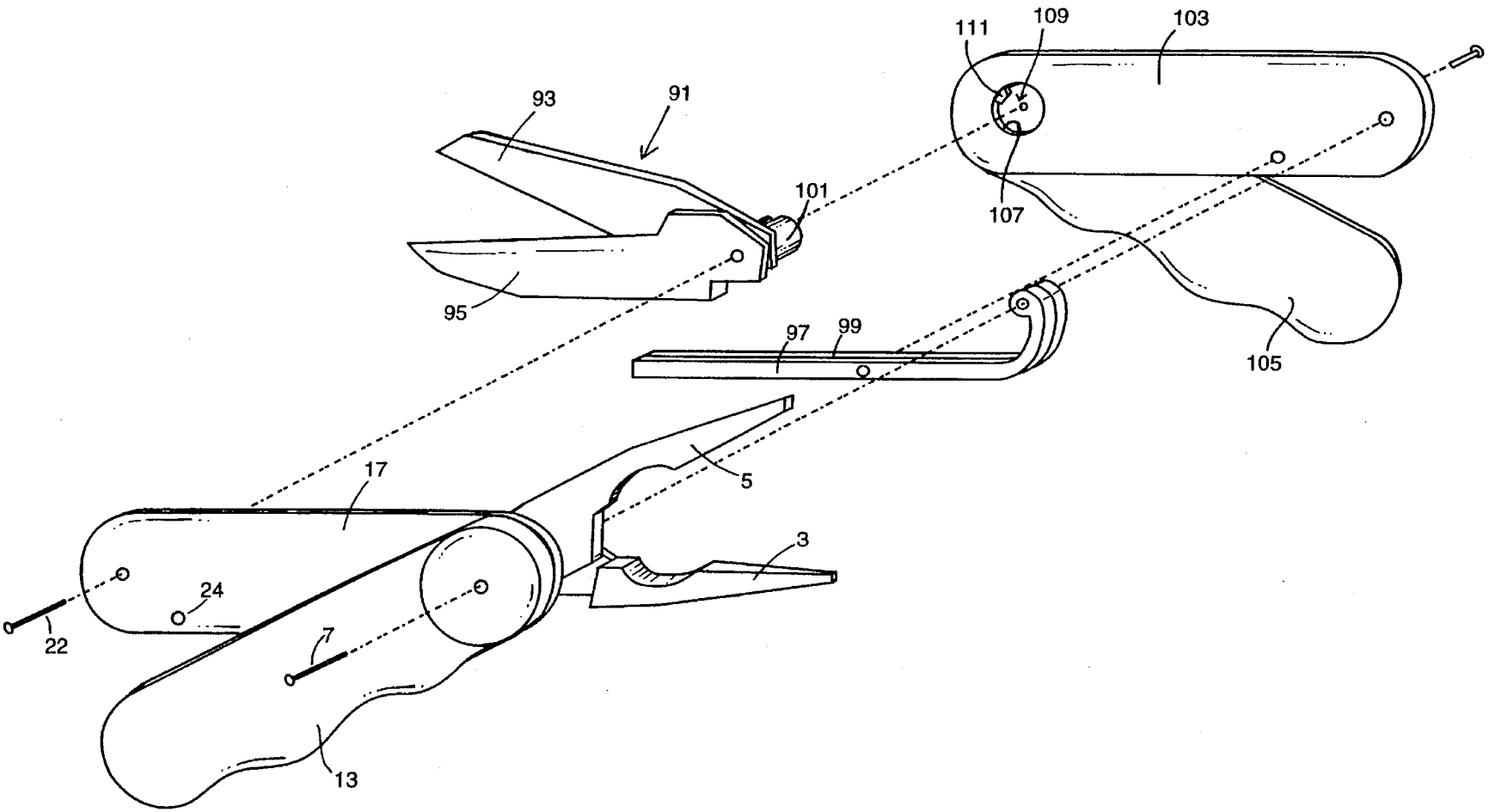
FIG. 13 is an exploded perspective view of a second alternate embodiment of the tool of the invention.

With reference to FIG. 13, another alternate embodiment is shown. In this alternate embodiment, a second jaw structure generally indicated at 91 is shown. This structure comprises two jaws 93 and 95 which coact in some operative fashion, such as, e.g., clippers. Each of the jaws is associated with a respective spring 97 and 99 and these jaws are substantially the same as jaws 3 and 5 in their interaction with the springs, i.e., spring 99 springingly locks the jaw 95 in the open position and spring 97 biases the jaw 93 to open away from jaw 95. The handle portion 19 (see FIG. 9) is replaced in this embodiment by a second support plate 103 and a third handle portion 105. The shaft 101 extends through an aperture 107 in support plate 103 and is received in a recess generally indicated at 109 in the third handle 105. Third handle 105 has an abutment portion 111 extending into the recess 109, and this abutment portion interacts with the shaft 101 in the same fashion as the abutment portion 51 of handle portion 13 interacts with the shaft 41 of jaw 5.

The handle 105 and the support member 103 serve as the two handles of the tool operating jaws 93 and 95 in the open position thereof. In their closed position, the jaws 93 and 95 lie in a space which is defined between support wall 103 and support wall 17 adjacent and in a similar fashion to jaws 3 and 5 in FIG. 1. In this embodiment, handle portion 105 is rotated relative to the support wall portions 103 and 17, causing the jaws 93 and 95 to move to the operative position. In normal use of the jaw structure 91 in the operative position, the jaws and 5 and handle 13 of the tool are folded into their closed position.

The terms of the foregoing specification should be viewed as terms of description and not limitation, as those skilled in the art having the specification before them will be able to make modifications and changes thereto without departing from the spirit of the invention herein.

Wherefore I claim:

1. A folding tool comprising:

first and second jaw structures rotatably connected with each other to pivot about an axis with respect to each other to and from a coacting position;

a first handle portion and a support portion pivotable relative to each other and rotatably connected with said jaw structure and pivoting with respect to said jaw structures about the axis of pivoting of said jaw structures relative to each other;

said support portion having a rotational stop portion engaging the second jaw structure and preventing relative movement thereof beyond an open position in which said second jaw structure extends substantially away from said support portion;

said support portion having a first spring thereon engaging said first jaw structure and biasing said first jaw structure away from said coacting position with the second jaw structure when said second jaw structure is in the open position.

2. The apparatus according to claim 1 and said jaw structures comprising coacting plier jaws.

3. The invention according to claim 1 and said rotational stop portion including a second spring engaging said second jaw structure and urging said second jaw structure into engagement with said rotational stop portion.

4. The apparatus according to claim 3 and said second spring abutting said second jaw structure and preventing movement thereof beyond the open position.

5. The apparatus according to claim 1 and said first and second jaw structure having coacting structure limiting relative rotational movement of said jaw structures away from coacting position.

6. The invention according to claim 1 and said first jaw structure having a lost-motion pivotal connection operatively associated with said first handle portion.

7. The invention according to claim 6 and said lost-motion connection permitting relative rotation of the first handle portion with respect to the first jaw structure less than about 180 degrees.

8. The invention according to claim 7 and said lost-motion connection having a shaft portion having a notch therein, and said handle portion having an abutment structure extending into said notch and moving therein during relative rotation of the handle portion.

9. The apparatus according to claim 1 and a second handle portion supported adjacent said support portion, said second handle portion and said support portion defining therebetween a space.

10. The apparatus according to claim 9 and said jaw structures entering into said space when the tool is folded.

11. The invention according to claim 10 and said spring biasing said jaw structures to remain within the space when the tool is in the folded condition.

12. The apparatus according to claim 9 and said spring extending between said second handle portion and said support portion.

13. The invention according to claim 12 and a tool structure supported on said second handle portion between said second handle portion and said spring.

14. A folding tool comprising:

first and second jaw structures pivotably connected with each other and pivoting with respect to each other about an axis to and from a coacting position;

a first handle portion and a support portion each rotatably connected with said jaw structures;

said support portion having first and second springs supported thereon, each spring being operatively associated with a respective jaw structure;

said first jaw structure having a surface portion engaging the first spring and being urged thereby to move away from the coacting position with the second jaw structure; and said second jaw structure having a stop portion engaging said second spring and resisting rotational movement of the second jaw structure with respect to the support portion beyond the point of said engagement.

15. The apparatus according to claim 14 and said jaw structure comprising a pair of pliers jaws.

16. The invention according to claim 14 and said jaws comprising a pair of clipper jaws.

17. The invention according to claim 14 and first jaw having a lost-motion connection engaging said first handle portion and limiting rotational movement therebetween to a range of less than or equal to about 180 degrees.

18. The invention according to claim 14 and a second handle portion extending adjacent to the support member and defining a space between, said jaw structures entering said space when the tool is folded, said jaw structures each having an engagement portion, said springs each engaging a respective engagement portion and urging the jaws into said space when the tool is folded.

19. The invention according to claim 14 and a tool structure supported between said second handle and said jaw structures and comprising a third spring extending between said second handle portion and said support member and a tool portion pivotally supported on said second handle portion.

20. A folding tool comprising:

first and second jaw structures pivotally connected with each other for limited relative pivoting movement about an axis;

said first jaw structure having a lost-motion connection including a shaft extending substantially along the axis of pivoting rotation of said jaw structures;

a first handle portion having a recess therein receiving said shaft and being rotatably supported thereon;

said shaft portion having first and second notch walls therein defining a notch therein;

said handle portion having a stop extending into said recess and into said notch and being movable within said notch between said notch walls as said handle portion is rotated relative to said shaft;

said notch walls being configured so that the limited rotational movement of said handle portion is in a range of less than about 180 degrees;

a support wall and second handle portion extending adjacent each other and each being pivotally connected with said jaw structures with pivotal movement about said axis;

said support wall portion and said second handle portion defining therebetween a space;

first and second springs extending within said space and being cantileverly supported therein between said support wall portion and said second handle portion;

said first and second jaw structures each having an open position engagement portion and a closed position engagement portion;

the closed position engagement portions of said jaw structures each engaging a respective spring when the jaw structures are rotated to extend adjacent said support wall portion, said springs biasing said jaw structures to remain within said space;

said open position engagement portion of said second jaw structure including a stop portion and a camming portion engaging said second spring at an open position wherein said second jaw structure extends generally away from said support wall portion, said camming structure urging said second jaw structure to move into engagement with said stop portion of said second jaw structure to engage said second spring;

said engagement of said stop portion and said second spring preventing rotation of the second jaw structure beyond said open position; and said open position engagement portion of said first jaw structure engaging the first spring when said first jaw structure is in an open position thereof wherein said first jaw structure extends generally away from said support wall portion, said first spring biasing the first jaw structure away from the coacting position with the second jaw structure.

21. The apparatus according to claim 20 and a latching structure latchingly securing said first handle portion against relative rotation with respect to said support wall member when the tool is folded.

22. The invention according to claim 20 and a tool structure supported between said springs and said second handle portion, said tool structure including:

first and second coacting jaws pivotable with each other, and first and second spring member extending between said springs and second handle portion;

said second handle portion including a support member and a handle, said spring member each engaging a respective jaw so that the jaws are biased apart when the jaws are rotated to a position wherein they extend generally away from said support member.

* * * * *